US009050713B2

(12) United States Patent
Hartmann et al.

(10) Patent No.: US 9,050,713 B2
(45) Date of Patent: Jun. 9, 2015

(54) POWER TOOL

(75) Inventors: Markus Hartmann, Mauerstetten (DE); Frank Kohlschmied, Munich (DE); Christian Daubner, Mammendorf (DE)

(73) Assignee: Hilti Aktiengesellschaft, Schaan (LI)

( * ) Notice: Subject to any disclaimer, the term of this patent is extended or adjusted under 35 U.S.C. 154(b) by 674 days.

(21) Appl. No.: 13/156,603

(22) Filed: Jun. 9, 2011

(65) Prior Publication Data

US 2011/0303431 A1 Dec. 15, 2011

(30) Foreign Application Priority Data

Jun. 10, 2010 (DE) ..... 10 2010 029 917

(51) Int. Cl.
*B25D 17/06* (2006.01)
*B25D 11/00* (2006.01)

(52) U.S. Cl.
CPC ..... *B25D 17/06* (2013.01); *B25D 11/005* (2013.01); *B25D 2217/0015* (2013.01); *B25D 2250/035* (2013.01); *B25D 2250/365* (2013.01)

(58) Field of Classification Search
CPC .... B25D 11/005; B25D 17/06; B25D 17/245; B25D 2205/365; B25D 2250/035; B25D 2217/0015
USPC ..... 173/212, 112, 200, 201, 114, 109, 14; 277/567
See application file for complete search history.

(56) References Cited

U.S. PATENT DOCUMENTS

| | | | | |
|---|---|---|---|---|
| 3,067,584 A | | 12/1962 | Atkinson | |
| 4,068,727 A | | 1/1978 | Andersson et al. | |
| 4,355,564 A | | 10/1982 | Gidlund | |
| 4,442,906 A | * | 4/1984 | Simpson | 173/48 |
| 4,624,325 A | | 11/1986 | Steiner | |
| 5,556,112 A | * | 9/1996 | Brandt | 277/560 |
| 5,775,440 A | * | 7/1998 | Shinma | 173/109 |
| 6,227,309 B1 | * | 5/2001 | Henke et al. | 173/201 |
| 6,237,699 B1 | * | 5/2001 | Plietsch et al. | 173/201 |
| 7,198,275 B2 | * | 4/2007 | Gravier | 277/438 |

FOREIGN PATENT DOCUMENTS

| | | |
|---|---|---|
| DE | 74 08 480 U | 6/1974 |
| DE | 26 10 990 A1 | 9/1976 |
| EP | 0 133 161 A1 | 2/1985 |

(Continued)

OTHER PUBLICATIONS

European Search Report, dated Oct. 6, 2011, 8 pages.

(Continued)

*Primary Examiner* — Andrew M Tecco
(74) *Attorney, Agent, or Firm* — Crowell & Moring LLP

(57) ABSTRACT

A power tool is disclosed. The power tool includes a striker, a guide tube in which the striker is guided along an axis, and a pneumatic chamber, which is closed by the striker, the guide tube and a valve device actuated by its own medium. A volume of the pneumatic chamber changes in the case of a movement of the striker along the axis. The valve device has a swivelable sealing element between the striker and the guide tube. The swivelable sealing element is swiveled into a retracted position when the striker moves in the impact direction and is swiveled into an extended position when the striker moves against the impact direction. In the retracted position, the sealing element has a first inflow surface. In the extended position, the sealing element has a second inflow surface. The second inflow surface is larger than the first inflow surface.

12 Claims, 4 Drawing Sheets

(56) References Cited

FOREIGN PATENT DOCUMENTS

| | | | |
|---|---|---|---|
| EP | 0 663 270 | A1 | 7/1995 |
| EP | 1 027 964 | A2 | 8/2000 |
| EP | 1 967 328 | A2 | 9/2008 |
| GB | 2 084 917 | A | 4/1982 |
| GB | 2 458 523 | A | 9/2009 |

OTHER PUBLICATIONS

U.S. Appl. No. 13/156,592, "Power Tool and Control Method", filed Jun. 9, 2011, Inventor Frank Kohlschmied, et al.
U.S. Appl. No. 13/156,608, "Power Tool", filed Jun. 9, 2011, Inventor Markus Hartmann, et al.
German Search Report, dated Dec. 20, 2012, 5 pages.

* cited by examiner

POWER TOOL

This application claims the priority of German Patent Document No. 10 2010 029 917.0, filed Jun. 10, 2010, the disclosure of which is expressly incorporated by reference herein.

BACKGROUND AND SUMMARY OF THE INVENTION

The present invention relates to a power tool, in particular a hand-operated chiseling power tool.

In the case of hand-held chiseling power tools, chiseling action is supposed to be suspended when a chisel is lifted off a workpiece. In the case of striking mechanisms that operate pneumatically, a pneumatic spring can be deactivated by means of additional ventilation openings, which are only opened if the chisel is disengaged. A striker, also called an intermediate striking device or anvil, is supposed to remain away from the ventilation openings for this purpose after an empty impact. However, this is not the case to some extent due to the rebound of the striker on the forward limit stop.

A power tool according to the invention has a striker, a guide tube in which the striker is guided along an axis, and a pneumatic chamber, which is closed by the striker, the guide tube and a valve device actuated by its own medium. A volume of the pneumatic chamber changes with the movement of the striker along the axis. The valve device actuated by its own medium has a swivelable sealing element between the striker and the guide tube. The swivelable sealing element, in the case of a movement of the striker in the impact direction, swivels into a retracted position and, in the case of a movement of the striker against the impact direction, swivels into an extended position. In the retracted position, the sealing element has a first inflow surface, defined by the projection of the sealing element onto a plane perpendicular to the axis. In the extended position, the sealing element has a second inflow surface, likewise defined as the surface of a projection of the sealing element onto the plane perpendicular to the axis. The second inflow surface is larger than the first inflow surface. In the retracted position, the radial dimension of the sealing element is less than in the extended position. The pneumatic chamber serves as a striker brake, which is controlled by the movement direction of the striker. The pneumatic chamber is closed by the valve device when the striker goes into the power tool after an empty impact for example. The pressure changing in the pneumatic chamber with the movement of the striker causes the striker to decelerate. The valve device opens the pneumatic chamber when the striker is moved in the impact direction. The brake is deactivated.

One embodiment provides that if the volume of the pneumatic chamber is increasing in the case of a movement of the striker in the impact direction, the swivelable sealing element will be swiveled into the retracted position when a pressure gradient is falling in the direction of the pneumatic chamber, and, when a pressure gradient is rising in the direction of the pneumatic chamber, will be swiveled into the extended position, and if the volume of the pneumatic chamber is decreasing in the case of a movement of the striker in the impact direction, the swivelable sealing element will be swiveled into the retracted position when a pressure gradient is rising in the direction of the pneumatic chamber and, when a pressure gradient is falling in the direction of the pneumatic chamber, will be swiveled into the extended position.

One embodiment has a further pneumatic chamber, which is closed by the striker, the guide tube and the valve device actuated by its own medium, wherein the volume of the one pneumatic chamber is increasing in the case of a movement of the striker in the impact direction and a volume of the further pneumatic chamber is decreasing in the case of a movement of the striker and wherein the pneumatic chamber and the further pneumatic chamber are connected by the valve device actuated by its own medium.

One embodiment provides that the sealing element is fastened on the striker and, in the extended position, a contact section of the sealing element touches the guide tube or alternatively the sealing element is fastened on the guide tube and, in the extended position, the contact section of the sealing element touches the striker. The touching contact section limits the swivel movement of the movable section of the sealing element. The sealing element is hereby stabilized in the extended position.

One embodiment provides that, if the volume of the pneumatic chamber is increasing in the case of a movement of the striker in the impact direction, a swivel joint of the sealing element opposite from the contact section is moved further away from the pneumatic chamber along the axis, and, if the volume of the pneumatic chamber is decreasing in the case of a movement of the striker in the impact direction, the swivel joint of the sealing element opposite from the contact section is arranged closer to the pneumatic chamber along the axis. The swivel joint may be formed by a solid-body joint.

One embodiment provides that the sealing element is fastened on the striker or the guide tube with a fastening section and a lip of the sealing element is inclined with respect to the axis, wherein, if the volume of the pneumatic chamber is increasing in the case of a movement of the striker in the impact direction, the lip is inclined away from the fastening section along the axis towards the pneumatic chamber, and, if the volume of the pneumatic chamber is decreasing in the case of a movement of the striker in the impact direction, the lip is inclined away from the fastening section along the axis away from the pneumatic chamber.

One embodiment provides that the sealing element has a V-shaped or U-shaped cross-sectional profile along the axis, wherein the cross-sectional profile is open in the direction of the pneumatic chamber, if the volume of the pneumatic chamber is increasing in the case of a movement of the striker in the impact direction, and the cross-sectional profile facing away from the pneumatic chamber is opened, if the volume of the pneumatic chamber is decreasing in the case of a movement of the striker in the impact direction.

One embodiment provides that the sealing element is asymmetric with respect to all planes perpendicular to the axis.

One embodiment has a limit stop on which the swivelable sealing element rests in the extended position and from which it is spaced apart in the retracted position. The limit stop supports the sealing element in the extended position against the forces acting on the sealing element.

One embodiment has a throttle, which connects the pneumatic chamber with an air reservoir. An effective cross-sectional area of pneumatic chamber defined by the differential of the volume of the pneumatic chamber in the impact direction is greater than a hundred times a cross-sectional area of the throttle. The striker is moved parallel to the axis, whereby a volume change of the pneumatic chamber is produced proportional to the displacement along the axis and the effective cross-sectional area. The effective cross-sectional area can be determined by the mathematical operation of differentiation in the movement or impact direction. In the case of a cylindrical guide and a cylindrical striker, the effective cross-sectional area corresponds to the largest cross-sectional area perpendicular to the axis. The ratio of the effective cross-sectional area of the pneumatic chamber to the cross-sectional area of the throttle determines a relative flow speed of the air in the throttle related to the speed of the striker. Starting at this relative flow speed the air can escape quickly enough from the pneumatic chamber without a drop in pressure with respect to the environment developing. It was recognized that an absolute speed of the air in the throttle cannot be exceeded. However, the throttle appears to block a limit value of the absolute speed. The ratio of a hundred times, preferably three-hundred times, is selected so that, in the case of a striker driven by the striking mechanism, the absolute speed of the air in the throttle is reached; in the case of a striker moved manually, the absolute speed is fallen short of considerably. As a result, the throttle blocks when the striker strikes, and opens when the striker is moved manually.

In the extended position of the swivelable sealing element, a flow channel through the valve device may have a cross-sectional area, which is less than one hundredth of the effective cross-sectional area of the pneumatic chamber. The cross-sectional area may be configured, for example, to be greater than 1/1500 or greater than 1/2000 of the effective cross-sectional area. The cross-sectional area of the closed/throttling valve may be formed in the sealing element by boreholes, notches and/or grooves running along the axis.

The following description explains the invention on the basis of exemplary embodiments and figures.

DETAILED DESCRIPTION OF THE DRAWINGS

Unless otherwise indicated, the same or functionally equivalent elements are identified in the figures by the same reference numbers.

Figure 1:
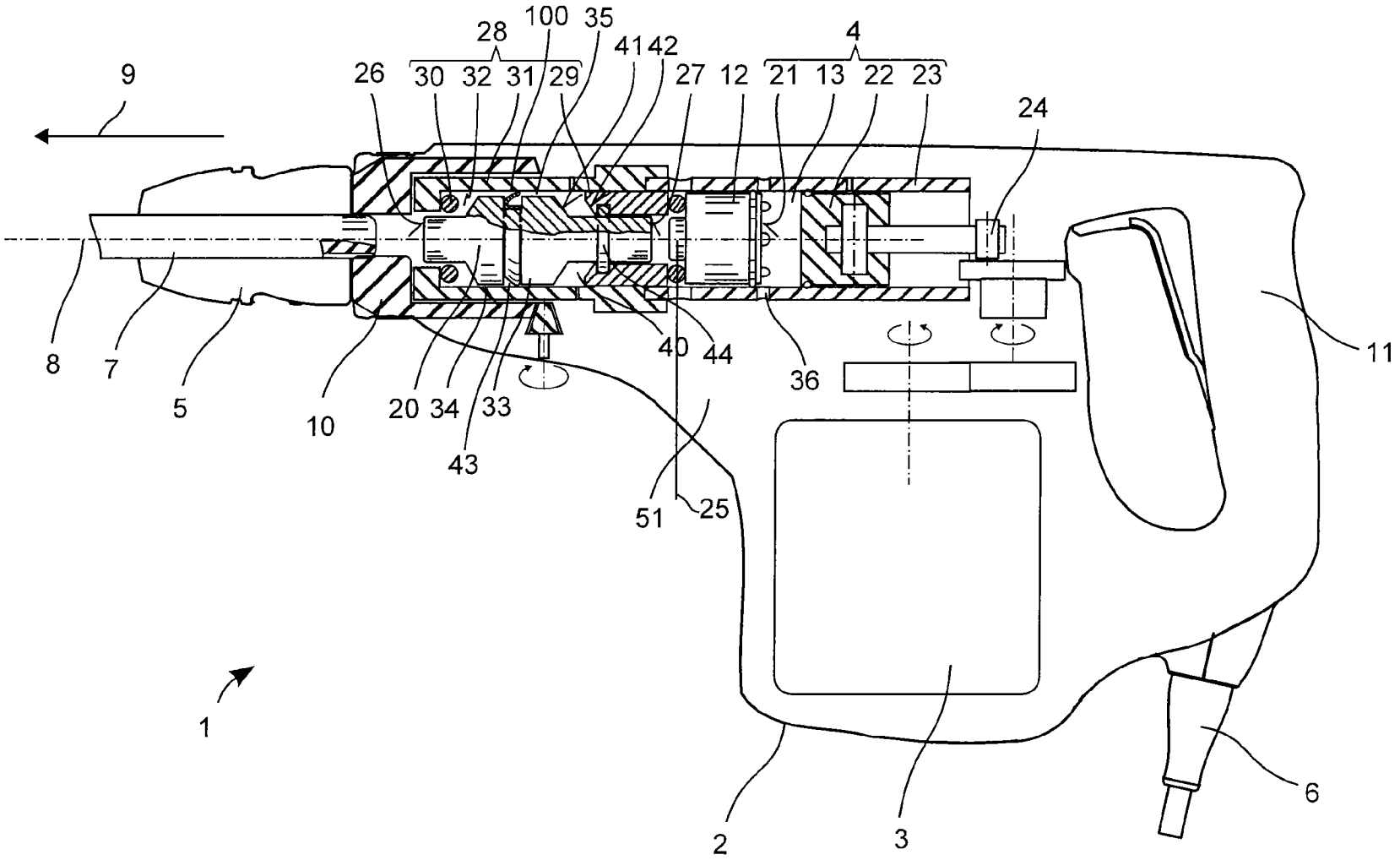
FIG. 1 illustrates a hand-held power tool with a pneumatic striking mechanism and a striker brake.

FIG. 1 shows a hammer drill 1 as an embodiment for a chiseling power tool. The hammer drill 1 has a machine housing 2, in which a motor 3 and a pneumatic striking mechanism 4 driven by the motor 3 are arranged, and a tool receptacle 5 is preferably fastened in a detachable manner. The motor 3 is, for example, an electric motor, which is supplied with electricity by a cable-based power supply 6 or a chargeable battery system. The pneumatic striking mechanism 4 drives a tool 7 inserted into the tool receptacle 5, e.g., a boring tool or a chisel, away from the hammer drill 1 along an axis 8 in the impact direction 9 into a workpiece. The hammer drill 1 optionally has a rotary drive 10, which can rotate the tool 7 around the axis 8 in addition to the impacting movement. One or two hand grips are fastened on the machine housing 2, which make it possible for a user to operate the hammer drill 1. A purely chiseling embodiment, e.g., a chisel hammer, differs from the hammer drill 1 essentially only by the lack of the rotary drive 10.

The pneumatic striking mechanism 4 depicted exemplarily has an impacting piston 12, which is induced by an excited pneumatic spring 13 to move forward, i.e., in the impact direction 9, along the axis 8. The impacting piston 12 hits a striker 20 and thereby releases a portion of its kinetic energy to the striker 20. Because of the recoil induced by the pneumatic spring 13, the impacting piston 12 moves backward, i.e., against the impact direction 9, until the compressed pneumatic spring 13 again drives the impacting piston 12 forward. The pneumatic spring 13 is formed by a pneumatic chamber, which is closed axially at the front by a rear face surface 21 of the impacting piston 12 and axially at the rear by an exciter piston 22. In the radial direction, the pneumatic chamber can be closed circumferentially by an impacting tube 23, in which the impacting piston 12 and the exciter piston 22 are guided along the axis 8. In other designs, the impacting piston 12 may slide in a cup-shaped piston, wherein the exciter piston closes the hollow space of the pneumatic chamber in the radial direction, i.e., circumferentially. The pneumatic spring 13 is excited by a forced, oscillating movement along the axis 8 of the exciter piston 22. An eccentric drive 24, a wobble drive, etc., can convert the rotational movement of the motor 3 into the linear, oscillating movement. A period of the forced movement of the exciter piston 22 is coordinated with the interplay of the system of the impacting piston 12, pneumatic spring 13 and striker 20 and their relative axial distances, in particular a predetermined impact point 25 of the impacting piston 12 with the striker 20 in order to excite the system resonantly and thus optimally for energy transmission from the motor 3 to the impacting piston 12.

The striker 20 is a body, preferably a rotating body, with a front impact surface 26 exposed in the impact direction 9 and a rear impact surface 27 exposed against the impact direction 9. The striker 20 transmits an impact on its rear impact surface 27 to the tool 7 adjacent to its front impact surface 26. In terms of its function, the striker 20 may also be designated as an intermediate striking device.

A guide 28 guides the striker 20 along the axis 8. In the depicted example, the striker 20 dips partially with a rear end into a rear guide section 29. The rear end is adjacent with its radial outer surface to the guide section 29 in the radial direction. A forward guide section 30 can likewise enclose a forward end of the striker 20 and restrict its radial movement. The rear and forward guide sections 29, 30 with their axially aligned surfaces together form two limit stops, which limit an axial movement of the striker 20 on a path between the rear limit stop 29 and the forward limit stop 30 situated in the impact direction 9 (striker limit stop). The striker 20 has a thickened center section 33, whose face surfaces strike against the axial surfaces of the guide sections 29, 30. The guide 28 depicted exemplarily has, for example, cylindrical, circumferentially closed guide tube 31, in which is the striker 20. The thicker section 33 of the striker 20 is spaced apart radially with its lateral surface 34, i.e., radial outer surface, at least in sections or along its entire circumference from an inner wall 32 of the guide tube 31. A channel-like or cylindrical gap 35 between the striker 20 and the guide tube 31 runs over the entire axial length of the center thickened section 33. The gap 35 may have a radial dimension of between 0.5 mm and 4 mm for example.

Figure 2:
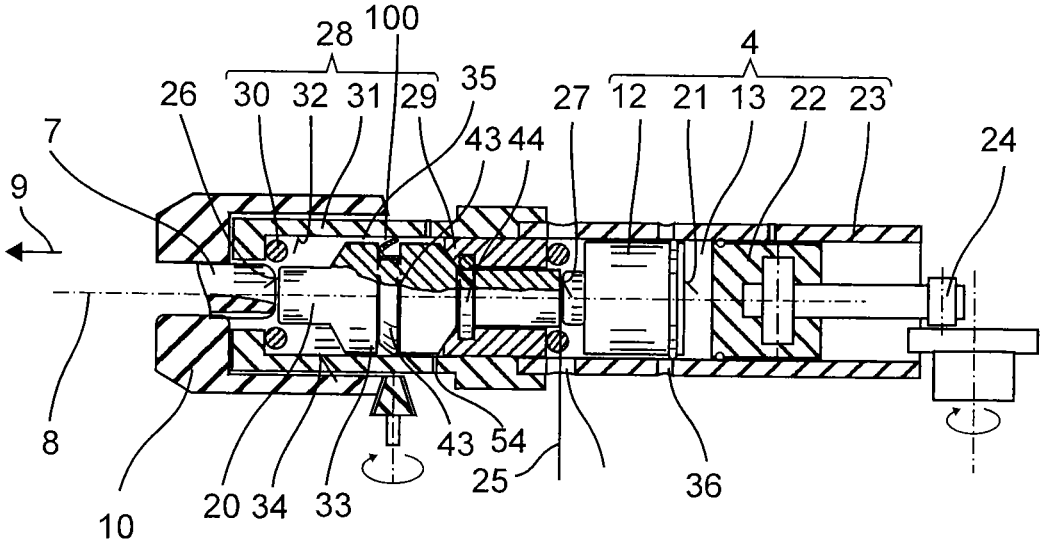
FIG. 2 illustrates the pneumatic striking mechanism in the operating position.

During chiseling, the tool 7 is supported on the forward impact surface 26 of the striker 20, whereby the striker 20 is kept engaged on the rear limit stop 29 (FIG. 2). The striking mechanism 4 is designed for the engaged position of the striker 20. The predetermined impact point 25 (FIG. 2) of the impacting piston 12 and the reversal point in the movement of the impacting piston 12 is determined by the rear impact surface 27 of the engaged striker 20.

As soon as a user removes the tool 7 from the workpiece, the impacting function of the pneumatic striking mechanism 4 is supposed to be interrupted, because otherwise the hammer drill 1 will idle percussively. When the impacting piston 12 impacts the striker 20, the striker 20 slides to the forward limit stop 30 and preferably stands still in its vicinity. The impacting piston 12 may move forward beyond the predetermined impact point 25 in the impact direction 9 up to the preferably dampening limit stop 30. In the advanced position beyond the impact point 25, the impacting piston 12 frees a ventilation opening 36 in the impact tube 23, through which the pneumatic chamber of the excited pneumatic spring 13 is connected and ventilated with preferably the environment in the machine housing 2. The effect of the pneumatic spring 13 is reduced or reversed, which is why the impacting piston 12 stands still because of the weakened or missing connection to the exciter piston 22. The striking mechanism 4 is reactivated, if the striker 20 is engaged up to the rear limit stop 29 and the impacting piston 12 closes the ventilation opening 36.

So that the striker 20 remains preferably in the vicinity of the forward limit stop 30 after an empty impact, the striker 20 can essentially move unchecked in the impact direction 9 to the forward limit stop 30; in the opposite direction from the rear limit stop 29, the movement occurs, however, against a spring force of at least a pneumatic spring 40. The spring force of the pneumatic spring 40 is controlled as a function of the movement direction of the striker 20 related to the guide 28.

An at least partially radially running surface of the striker 20 and an at least partially radially running surface of the guide 28 form inner surfaces of the pneumatic chamber 40 for the pneumatic spring, which is oriented perpendicularly or inclined to the axis 8. An axial distance of the two radially running surfaces changes with the movement of the striker 20 and therefore the volume of the pneumatic chamber 40. The change in volume causes a change in the pressure within the pneumatic chamber 40.

A rear bounce surface 41 of the thicker section 33 that points opposite from the impact direction 9 can form the first radially running inner surface of the pneumatic chamber 40. A rear bounce surface 42 of the guide 28 pointing in the impact direction 9, which together with the rear bounce surface 41 of the thicker section 33 defines the rear limit stop 29, can be the second radially running inner surface of the pneumatic chamber 40.

In the radial direction, the pneumatic chamber 40 is closed on one side by the guide 28 and on the other side by the striker 20. A hermetic air-tight seal between the striker 20 and the guide 28 is realized by a first sealing element 43 and a second sealing element 44. The sealing elements 43, 44 are arranged offset from one another along the axis 8. The first sealing element 43 is arranged, for example, between the two limit stops 29, 30, and the second sealing element 44 is arranged axially outside of the two limit stops 29, 30, i.e., of the respective bounce surface 42. Located between the two sealing elements 43, 44 are the radially running inner surfaces of the pneumatic chamber 40. In the depicted embodiment, the sealing elements 43, 44 are arranged on sections of the striker 20 having different cross sections, whereby the distances of the sealing elements 43, 44 to the axis 8 are different sizes. In other embodiments, at least sections of the sealing elements 43, 44 are at different distances from the axis 8. In a projection onto a plane perpendicular to the axis 8, the two seals do not overlap or at least not in sections.

The dependence of the pneumatic spring 40 on the movement direction of the striker 20 is achieved in that at least one of the sealing elements 43, 44 is configured as a valve 100. An air channel 45 links the pneumatic chamber 40 to an air reservoir in the environment, e.g., the machine housing 2. Arranged in the channel 45 is the valve 100 which controls the air flow through the channel 45. Control takes place as a function of the movement of the striker 20. When the striker 20 moves in the impact direction 9, the valve 100 opens and air can flow in from the reservoir through the channel 45 into the enlarging volume of the pneumatic chamber 40; the pneumatic spring is herewith deactivated. The valve 100 blocks the channel 45 if the striker 20 moves against the impact direction 9. The pressure in the pneumatic chamber 40 rises with the reducing volume of the pneumatic chamber 40, whereby the pneumatic spring 40 works against the movement of the striker 20.

The valve 100 is an automatic valve or a valve 100 actuated by its own medium, e.g., a check valve or a throttle check valve. The valve 100 is actuated by an air flow, which flows into the valve 100. The air flow is a consequence of a pressure difference between the pneumatic chamber 40 and the space 51 connected to it via the valve 100. The connected space 51 may be a very large air reservoir, e.g., the environment, the inside of the machine housing 51, or another closed pneumatic chamber with a limited volume.

Figure 3:
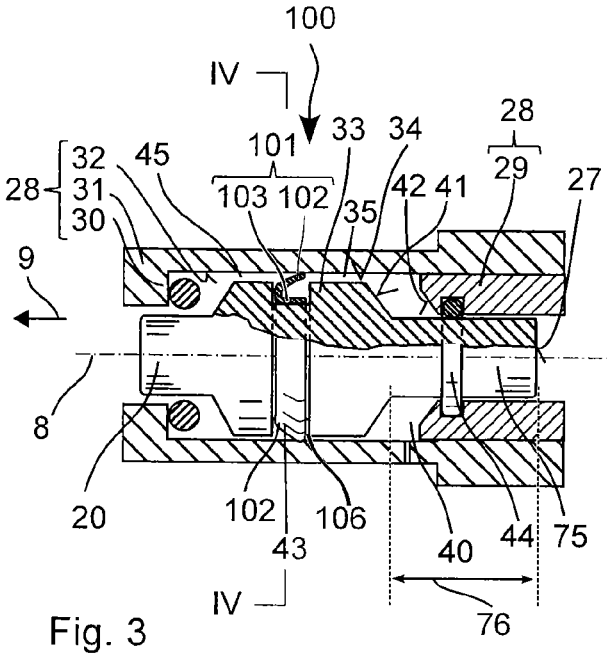
FIG. 3 illustrates the striker brake with a chamber and moved valve in the braked position.
Figure 4:
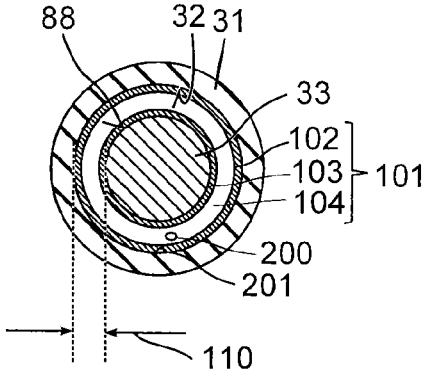
FIG. 4 is a cross section in plane IV-IV of FIG. 3.
Figure 5:
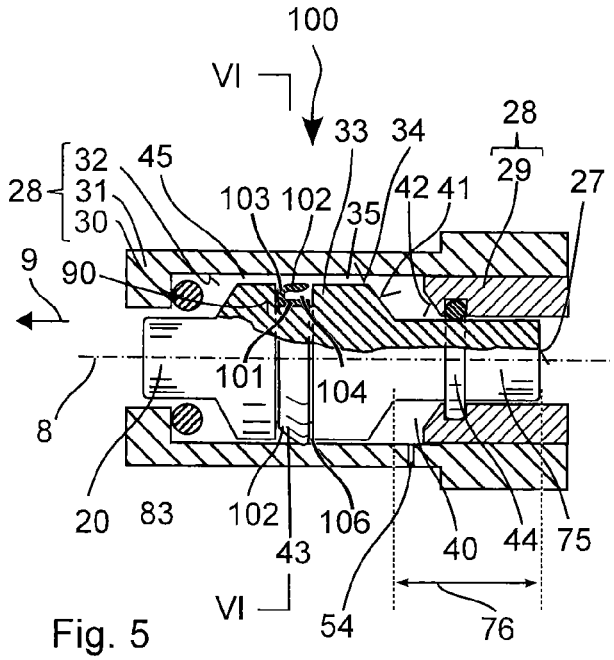
FIG. 5 is the striker brake from FIG. 3 in the released position.
Figure 6:
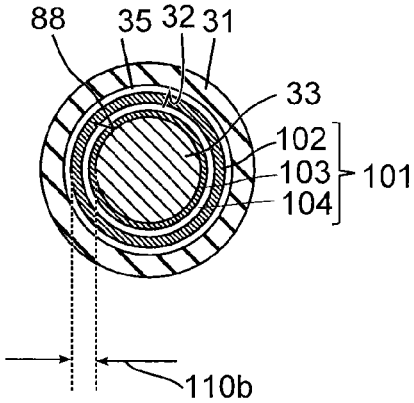
FIG. 6 is a cross-section in plane VI-VI of FIG. 5.
Figure 7:
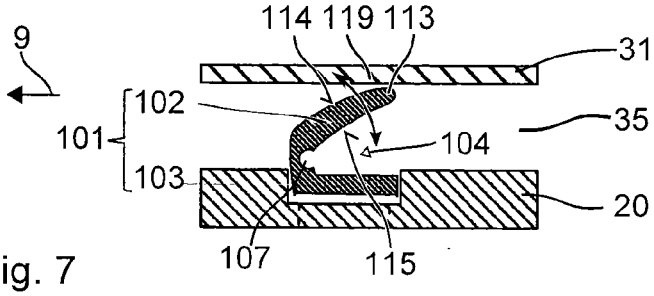
FIG. 7 is a detailed view of a valve.

FIG. 3 and FIG. 5 show a longitudinal section through the striking mechanism of an exemplary embodiment of the valve 100 in closed and opened positions. Cross-sections through the closed valve 100 in the plane IV-IV and the opened valve 100 in the plane VI-VI are depicted in FIG. 4 and FIG. 6. FIG. 7 shows an enlarged partial section of the valve 100.

A lip seal ring 101 clasps the center section 33 of the striker 20. The lip seal ring 101 has a tubular, cylindrical fastening section 103, with which the lip seal ring 101 is fastened on the striker 20. The fastening section 103 can be used, for example, on the groove base 88 in a annular groove 106 in the center section 33. Alternatively or additionally, the fastening section 103 can be clamped, adhered or otherwise fastened to the striker 20 in order to inhibit the lip seal ring 101 from slipping along the axis 8.

A lip 102 of the lip seal ring 101 is inclined with respect to the axis 8 and a radial distance from the fastening section 103 increases in the direction of the pneumatic chamber 40. The contour of the lip 102 can, for example, be in the shape of a hollow cone in sections with a cone opening in the direction of the pneumatic chamber 40. The lip 102 and the fastening section 103 enclose a pocket-like hollow space 104, which is open in the direction of the pneumatic chamber 40 and closed in the direction away from the pneumatic chamber 40. The lip seal ring 101 is arranged in front of the pneumatic chamber 40 in the impact direction 9 and the pocket-like hollow space 104 opens against the impact direction 9. The lip seal ring 101 has a V-shaped or U-shaped profile in a section longitudinally to the axis 8.

The lip 102 can be swiveled with respect to the fastening section 103 so that a radial dimension 110 of the lip seal ring 101 is variable. The radial dimension 110, for example, may be the difference from the outside diameter to the inside diameter of the lip seal ring 101. The lip seal ring 101 may assume an extended position (FIG. 4), in which the lip 102 is swiveled in the greatest possible distance from the fastening section 103. A face surface of the lip seal ring 101, which is oriented perpendicularly to the axis 8, corresponds, for example, to the cross-sectional area of the gap 35. In the depicted embodiment, the lip 102 touches the guide tube 31 with a contact section 113. The lip seal ring 101 can be swiveled from the extended position into a retracted position (FIG. 6). The face surface of the lip seal ring 101 is minimized hereby with respect to the face surface of the extended lip seal ring 101; the radial dimension 101*b* is reduced. The contact section 113 disengages from the guide tube 31.

The lip seal ring 101 forms the sealing element of the valve 100. In the case of an extended lip seal ring 101, the valve 100 is in a closed throttling position and with a retracted lip seal ring 101 the valve 100 is in an opened position. The change of the lip seal ring 101 between the retracted and extended position is caused by the pressure ratio in the pneumatic chamber 40 and the flow direction in the gap 35. An air flow in the direction of the rear, pneumatic chamber 40 flows against a surface 114 of the lip 102 pointing in part radially to the guide 28. The inflowing air causes a swiveling of the lip 102 in the direction of the fastening section 103 and consequently a retraction of the lip seal ring 101. The continued inflow of air keeps the lip seal ring 101 in the retracted position, thereby keeping the valve 100 open. An air flow from the rear, pneumatic chamber 40 flows, on the other hand, against a surface 114 of the lip 102 pointing in part radially away from the guide 28. The inflowing air thereby causes a swiveling of the lip 102 away from the fastening section 103 towards the guide tube 31. The lip seal ring 101 shifts into the extended position. In the extended position, the swivelable lip 102 rests against a limit stop 119 with at least one section of the surface 114 pointing away from the pneumatic chamber 40. The limit stop 119 is formed, for example, by the guide tube 31 on which the contact section 113 rests. The valve 100 is closed and remains held closed.

The lip 102 may be made of an elastic material, e.g., rubber. A thickness of the lip 102 may be considerably less than its dimension along the axis 8. The relatively low thickness of the lip 102 makes it possible for the air flow in and/or out of the pneumatic chamber 40 to swivel the lip 102 through bending. The lip 102 is, for example, elastically pre-stressed in the extended position. In an initial position the valve 100 is closed. In this embodiment, it is sufficient that the air flow into the pneumatic chamber 40 causes the bending.

The lip 102 and the fastening section 103 may be a one-piece, monolithic component or a component that is injection molded in one piece of the same material, e.g., rubber. A region in which the swivelable lip 102 merges into the immovable fastening section 103 opposite from the striker 20 may be further removed from the pneumatic chamber 40 than the contact section 113.

A solid-body joint 107 can connect the lip 102 to the fastening section 103. The solid-body joint 107 has a lower thickness than the lip 102, whereby a swivel movement takes place predominantly around the solid-body joint 107.

The second sealing element 44 may be arranged offset axially from the rear limit stop 29 against the impact direction 9 and can, for example, be a sealing ring positioned in a stationary manner in the guide 28. The sealing ring 44 is inserted, for example, in the sleeve 29 and terminates flush with a rear end 75 of the striker 20. The rear end 75 of the striker 20 has, for example, a smaller diameter than the center section 33.

Figure 8:
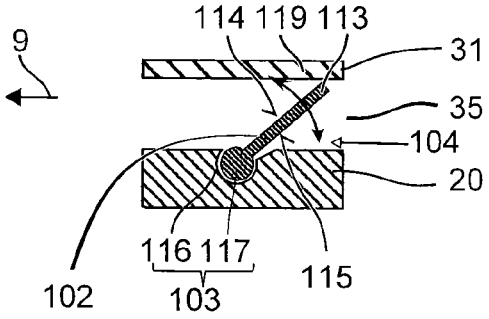
FIG. 8 is an embodiment with a different valve design.

FIG. 8 shows an embodiment in which the lip 102 is pivot-mounted in a separate fastening section 103. The fastening section 103 has a bearing shell 116, in which a bearing head 117 of the lip 102 is inserted.

Figure 9:
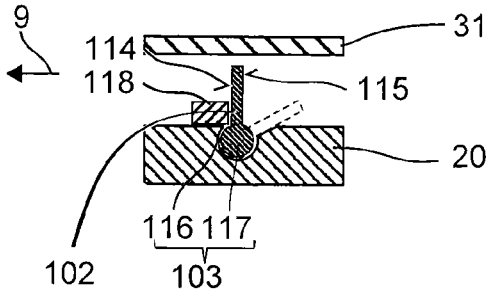
FIG. 9 is an embodiment with a different valve design.

FIG. 9 shows another embodiment of the valve 100. On the side that is away from the pneumatic chamber 40, a limit stop 118 rises from the fastening section 103 in the radial direction. The lip 102 rests on the limit stop 118 with a section of its surface 114 facing away from the pneumatic chamber 40 when the lip seal ring 101 is extended. In the retracted position, the lip 102 is swiveled away from the limit stop 118 (depicted as dashed lines). The limit stop 118 on the striker 20 limits the lip 102 during the swivel movement. The embodiment with the limit stop 118 is depicted, for example, with a rotatably mounted lip 102, but may likewise be used also for a lip 102 that is flexible due to a solid-body joint 107 or flexible over its length.

In another embodiment, the sealing element 101 is anchored in the inner wall and the lip 102 touches the striker 20.

Figure 10:
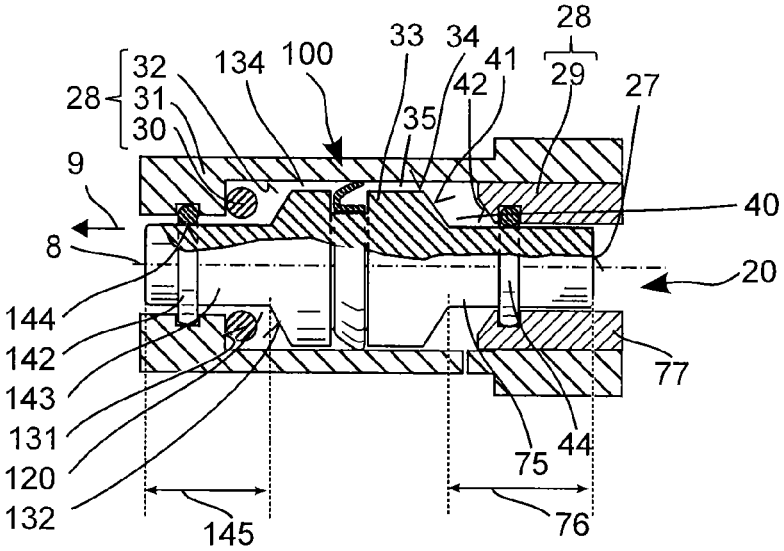
FIG. 10 is a striker brake with two chambers.

FIG. 10 shows a longitudinal section of another embodiment with a rear pneumatic spring 40, a forward pneumatic spring 120 and at least the valve 100 for controlling the behavior of the striker 20. In the case of forward movement, i.e., in the impact direction 9 of the striker 20, the volume of the rear pneumatic chamber 40 increases and the volume of the front pneumatic chamber 120 decreases. The displaced air volume in the forward pneumatic chamber 120 may flow through the valve 100 into the rear pneumatic chamber 40. In the case of a backward movement, i.e., against the impact direction 9 of the striker 20, the volume of the forward pneumatic chamber 120 increases and the volume of the rear pneumatic chamber 40 decreases. The spring force of the rear pneumatic spring 40 and the front pneumatic spring 120 is controlled as a function of the movement direction of the striker 20. The valve 100 prevents an air flow, which would equalize the increased pressure in the rear pneumatic chamber 40 and the reduced pressure in the forward pneumatic chamber 120. The backward movement therefore takes place against the spring force of the two pneumatic springs 40 and 120 and is braked. The spring force of the pneumatic springs 40, 120 may be different; the pressure-loaded rear pneumatic spring 40 may develop a greater braking effect than the forward pneumatic spring 120.

The forward pneumatic chamber 120 of the forward pneumatic spring has a forward inner wall 131 running at least partially radially, which is formed by the guide 28, and a rear inner wall 132 running at least partially radially, which is formed by the striker 20. The rear pneumatic chamber 40 of rear pneumatic spring has a forward inner wall 41 running at least partially radially, which is formed by the striker 20, and a rear inner wall 42 running at least partially radially, which is formed by the guide 28. In the radial outward direction, the pneumatic chambers 40, 120 are closed by the inner wall 32 of the cylindrical or prismatic guide tube 31. In the radial inward direction, the pneumatic chambers 40, 120 are closed by striker 20. Arranged axially offset from one another in the radial gap 35 for the sliding movement of the striker 20 in the guide 28 are a first sealing element 43 and a second sealing element 44 in order to seal the rear pneumatic chamber 40 in an air-tight manner. The forward and rear inner walls 41, 42 of the rear pneumatic chamber 40 are arranged along the axis 8 between the first sealing element 43 and the second sealing element 44. A third sealing element 142 is arranged in the impact direction 9 in front of the forward inner wall 131 of the forward pneumatic chamber 120. The forward and the rear inner walls 131, 132 of the forward pneumatic chamber 120 are situated along the axis 8 within the first sealing element 43 and the third sealing element 133.

The forward and rear pneumatic chambers 40, 120 that are coupled via the air channel 134 have a constant air volume that is closed from the environment, wherein a distribution of the air volume to the two chambers 40, 120 varies as a function of the momentary position of the striker 20.

Figure 11:
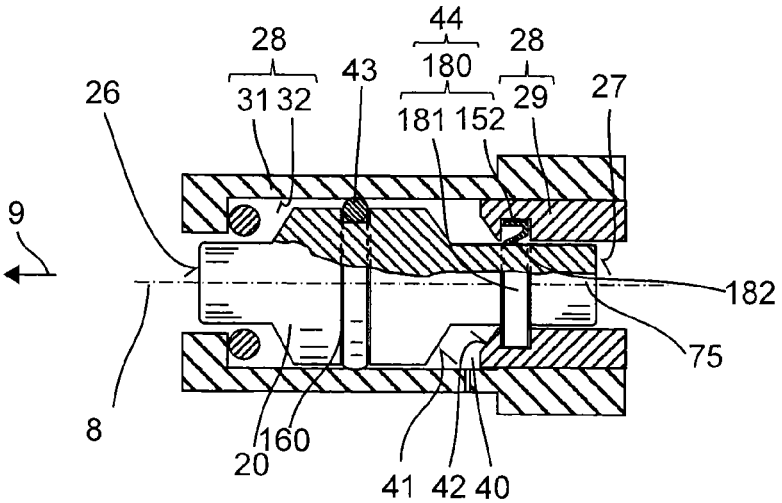
FIG. 11 is a striker brake with a stationary valve.

FIG. 11 shows an embodiment with a stationary valve 180 with a pneumatic chamber 40 whose volume increases in the case of the movement of the striker 20 in the impact direction 9. The structure of the valve 180 may correspond to the valve 100. A lip seal ring 181 of the valve 180 is fastened in the guide 28 and, for example, inserted into an annular groove of a sleeve 29 introduce in the guide tube 31. An annular, swivelable lip 182 is inclined with respect to the axis 8 and moves away from the guide 28 in the direction of the pneumatic chamber 40. In the depicted embodiment, the swivelable lip 182 can touch the striker 20 in an extended position. For example, the swivelable lip 182 touches the striker 20 on its end section 75 with a smaller diameter. An air flow in the pneumatic chamber 40 swivels the lip 182 away from the striker 20, thereby opening the valve 180. The first sealing element 43 on the circumference of the center section 33 can have permanent sealing element or a valve, which is inserted, for example, into an annular groove 160 in the center section.

The speed of the striker 20 in the impact direction 9 is approximately in the range of 1 m/s to 10 m/s in the case of an empty impact. The volume of the pneumatic chamber 40 increases correspondingly rapidly. Air flows through the opened valve 100 into the pneumatic chamber 40 at a high rate so that a pressure equalization quickly adjusts. In its opened position, the valve 100 frees a surface than can be flowed through (hydraulic surface) for this, which is at least $1/30$, preferably at least $1/20$, or at least 10% of the annular, effective cross-sectional area of the volume of the pneumatic chamber 40. The hydraulic surface is defined perpendicular to the flow direction in the valve 100. The effective cross-sectional area is the differential of the volume in the movement direction, i.e., the change in the volume is determined from the product of the effective cross-sectional area and the longitudinal displacement of the striker 20. When the striker 20 is reflected on the striker limit stop 30, its speed against the impact direction 9 can be in the same order of magnitude of 1 m/s to 10 m/s. The valve 100 closes and the compression of the closed pneumatic chamber 40 brakes the striker 20. The throttle opening 54 allows only a low airflow to escape, thereby maintaining the overpressure in the pneumatic chamber 40.

In the case of a slow movement of less than 0.2 m/s against the impact direction 9, typical for a new application of the chisel, the air may escape through the throttle opening 54 at a rate adequate to facilitate pressure equalization. The throttle opening 54 can, for example, be a borehole through the wall of the guide tube 31. The surface of a flow cross-section (hydraulic cross-section) of the throttle opening 54 is smaller by at least two orders of magnitude than the annular cross-sectional area of the pneumatic chamber 40, e.g., less than 0.5 percent. The throttle opening 54 is, for example, greater than $1/2000$ or $1/1500$ of the annular cross-sectional area in order to make a manual insertion of the striker 20 possible. The flow cross-section or the cross-sectional area of the throttle opening 54 is determined at its narrowest point perpendicular to the flow direction. With the movement of the striker 20, the volume of the pneumatic chamber 40 changes proportionally to the speed of the striker 20 and to the annular cross-sectional area of the volume surrounded by the pneumatic chamber 40. If the throttle 54 is supposed to equalize the volume change without a pressure change, the displaced air must pass through the throttle 54 at a speed that is at least a hundred times the speed of the striker. The flow characteristics of air set an upper limit for the flow speed, which is why a pressure equalization is possible with a slow moving but not with a rapidly moving striker 20.

As an alternative to a separate throttle opening 54, the valve 100 may be designed as a throttle valve, which leaves open an appropriate throttle opening in a closed/throttling position. For example, the lip seal ring 101 can have boreholes 200 running axially from a side facing the pneumatic chamber 40 to a side facing away from the pneumatic chamber 40. The diameter of the axial boreholes may have a cross-section, for example, whose area is at least two orders of magnitude smaller than in the area of the flow cross-section (hydraulic cross section) of the opened valve 100, for example, less than 0.5% and greater than 0.05%.

A throttle may also be rendered possible by a lip 102 that does not completely close on the guide 31. The lip may have notches 201 on its section 113 that touches. A flow cross-section of the throttle between the notch 201 and the guide 31 lies in the aforementioned limits of at most $1/100$, e.g., less than $1/300$ of the effective cross-sectional area, i.e., in the depicted example of the annular cross-sectional area of the volume of the pneumatic chamber 40. Alternatively or additionally, channels for the throttle may be positioned along the fastening section 103 by narrow channels in the fastening section 103 or in the groove base 106.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A power tool, comprising:

a striker;

an exciter piston and an impacting piston, wherein a first pneumatic chamber is defined between the exciter piston and the impacting piston and wherein the impacting piston is contactable on the striker;

a guide tube in which the striker is guided along an axis; and a second pneumatic chamber which is closed by the striker, the guide tube, and a valve device associated with the striker, wherein a volume of the second pneumatic chamber is variable based on a movement of the striker along the axis;

wherein the valve device has a swivelable sealing element disposed between the striker and the guide tube, wherein the swivelable sealing element is swivelable into a retracted position when the striker moves in an impact direction, wherein the swivelable sealing element is swivelable into an extended position when the striker moves against the impact direction, wherein the swivelable sealing element is swivelable into the retracted position by air flowing into the second pneumatic chamber, and wherein the swivelable sealing element is swivelable into the extended position by air flowing out of the second pneumatic chamber.

2. The power tool according to claim 1, wherein the sealing element is fastened on the striker and, in the extended position, a contact section of the sealing element touches the guide tube.

3. The power tool according to claim 1, wherein the sealing element is fastened on the guide tube and, in the extended position, a contact section of the sealing element touches the striker.

4. The power tool according to claim 1, wherein the sealing element includes a swivel joint and wherein the swivel joint is formed by a solid-body joint.

5. The power tool according to claim 1, wherein the sealing element is fastened on the striker or the guide tube with a fastening section and wherein a lip of the sealing element is inclined with respect to the axis.

6. The power tool according to claim 1, wherein the sealing element has a V-shaped or U-shaped cross-sectional profile along the axis.

7. The power tool according to claim 1, wherein the sealing element is asymmetrical with respect to all planes perpendicular to the axis.

8. The power tool according to claim 1, further comprising a limit stop on which the swivelable sealing element rests in the extended position and from which it is spaced apart in the retracted position.

9. The power tool according to claim 1, further comprising a throttle opening associated with the second pneumatic chamber wherein an effective cross-sectional area of the second pneumatic chamber is greater than a hundred times a cross-sectional area of the throttle.

10. The power tool according to claim 1, wherein in the extended position of the swivelable sealing element, a flow channel through the valve device has a cross-sectional area which is less than one hundredth of an effective cross-sectional area of the second pneumatic chamber.

11. The power tool according to claim 10, wherein the cross-sectional area is formed in the sealing element by boreholes, notches and/or grooves running along the axis.

12. The power tool according to claim 1, wherein the valve device is in contact with the striker and the guide tube when the striker is in a rearward-most position.

* * * * *